United States Patent [19]

Shaw

[11] 4,039,330

[45] Aug. 2, 1977

[54] NICKEL-CHROMIUM-COBALT ALLOYS

[75] Inventor: Stuart Walter Ker Shaw, Sutton Coldfield, England

[73] Assignee: The International Nickel Company, Inc., New York, N.Y.

[21] Appl. No.: 536,173

[22] Filed: Dec. 24, 1974

Related U.S. Application Data

[63] Continuation-in-part of Ser. No. 241,443, April 5, 1972, abandoned.

[30] Foreign Application Priority Data

Apr. 7, 1971 United Kingdom ..... 08978/71

[51] Int. Cl.[2] ..... C22C 19/05

[52] U.S. Cl. ..... 75/171; 75/134 F; 148/32.5

[58] Field of Search ..... 75/171, 170, 134 F; 148/32, 32.5

[56] References Cited

U.S. PATENT DOCUMENTS

| | | | |
|---|---|---|---|
| 3,459,545 | 8/1969 | Bieber et al. | 75/171 |
| 3,479,157 | 11/1969 | Richards et al. | 75/171 |
| 3,832,167 | 8/1974 | Shaw et al. | 75/171 |

*Primary Examiner*—R. Dean

*Attorney, Agent, or Firm*—Raymond J. Kenny; Ewan C. MacQueen

[57] ABSTRACT

A nickel-base alloy containing correlated percentages of chromium, cobalt, tungsten, molybdenum, titanium, aluminum, carbon, tantalum, niobium, zirconium, hafnium, boron, yttrium and lanthanum displays excellent stress rupture strength at elevated temperatures together with good corrosion resistance in sulphur- and chloride-containing environments.

8 Claims, No Drawings

NICKEL-CHROMIUM-COBALT ALLOYS

This present invention is a continuation-in-part of Ser. No. 241,443 filed Apr. 5, 1972, now abandoned and is directed to nickel-chromium-cobalt base casting alloys and to castings made therefrom.

As is generally known in the art, nickel-chromium and nickel-chromium-cobalt base alloys often contain precipitation hardening elements such as titanium and aluminum for strengthening purposes. Such alloys develop, on suitable heat treatment, a high level of stress-rupture strength at high temperature and are widely used in applications in which both high stress and elevated temperatures are encountered, gas turbine engine rotor blades being illustrative. However, by reason of the impure fuels used in land-based gas turbines there arises attendant problems involving incomplete combustion and sulphidation attack. Operation in marine and other chloride-containing environments has also resulted in the past in severe corrosion problems.

One way of enhancing the level of corrosion resistance is to increase the chromium content, as described for instance in U.K. Specifications Nos. 959,509 and 1,199,240, which relate to alloys containing at least 27% chromium. These alloys do suffer however from the drawback in respect of the level of strength obtainable without problems of instability by sigma formation and embrittlement after extended service. Moreover, they generally relate to wrought alloys, which are of limited utility for manufacturing turbine blades having complex cooling passages. Thus, the invention is addressed to the task of developing an alloy that possesses, in case form, a high level of strength at elevated temperature in conjunction with good corrosion resistance in sulphur- and chloride-containing environments.

It has now been found that certain nickel-base alloys containing correlated percentages of carbon, chromium, cobalt, molybdenum, tungsten, columbium, tantalum, titanium, aluminum, zirconium, boron, etc. exhibit excellent high temperature strength while concomitantly manifesting a good degree of resistance to corrosive attack of the type in question. In addition, they afford a good level of resistance to embrittlement.

Generally, speaking and in accordance herewith, the present invention contemplates alloys containing (by weight) about 0.02 to 0.25% carbon, from 20 to 25% chromium, from 5 to 25% cobalt, from 1 to 5% tungsten, from 0 to 3.5% molybdenum, with the value of %W + 0.5 (%Mo) being from 1 to 5%, from about 1.7 to 5% titanium and from 1 to 4% aluminum, the sum of the titanium plus aluminum being from 4 to 6 or 6.5% and the ratio of titanium to aluminum being from 0.75:1 to 4:1, from 0 to 3% niobium, from 0.5 to 3% tantalum, 0.005 to 1% zirconium and 0 to 2% hafnium, with the value of %Zr + 0.5 (%Hf) being from 0.01 to 1%, from 0.001 to 0.05% boron, and from 0 to 0.2% in total of yttrium and/or lanthanum, the balance, apart from impurities, being nickel, the nickel being at least 30%.

To obtain the desired combination of high stress-rupture strength, corrosion resistance and structural stability, it is important to maintain the proportions of each of the constituents within the limits set forth above. Thus, the alloys must contain at least 20% chromium for good corrosion-resistance, but the maximum level should not exceed 25% to avoid the risk of sigma formation during prolonged high temperature service. Preferably, the chromium content is from 21 to 24% and most preferably it is about 23%. The alloys are strengthened by the presence of from 5 to 25%, and preferably from 10 to 20%, cobalt. More than 25% cobalt, however, leads to sigma formation. The alloys are further strengthened by the co-presence of titanium, aluminum and tantalum, preferably, also niobium. However, more than 3% of either niobium or tantalum gives rise to the risk of embrittlement and loss of impact strength. The niobium is beneficially from 0.3 to 2% and the tantalum from 0.6 to 2.5%.

With further regard to titanium and aluminum, the sum thereof should be from 4 to not more than 6.5% and advantageously not more than about 6%. Outside this range stress-rupture strength falls off and, additionally, too much titanium and aluminum renders the alloys susceptible to embrittlement on prolonged heating at elevated temperature. Advantageously, the sum of these constituents is from 4.75 to 6 or 6.5%. The ratio of titanium to aluminum is also important and should be maintained from 0.75:1 to 4:1, preferably from 1:1 to 3:1. The best combination of strength, ductility and corrosion resistance is shown by alloys in which the ratio is about 2:1.

Turning to the elements tungsten and molybdenum, these constituents contribute to high strength. In striving for best results it has been found that 1 to 4% of tungsten should be present. The tungsten can be omitted but at a real sacrifice in strength. In such an instance the titanium plus aluminum should be maintained not higher than 6% and the value of %W + 0.5 % (Mo) must be from 0.5 to 5%.

The carbon content of the alloys is of importance. Amounts below 0.02% lead to a reduction in stress-rupture strength, while more than 0.25% renders the alloys susceptible to embrittlement. Preferably the carbon content is from 0.04 to 0.2%. Zirconium must be present in an amount of from 0.005 to 1% either with or without from 0 to 2% hafnium, with the proviso that the value of %Zr + 0.5 (%Hf) is from 0.01 to 1%, so that the alloy possesses good stress-rupture strength and ductility. For the same reasons, from 0.001 to 0.05% boron must be present. Amounts of boron in excess of 0.05% lead to inadequate impact resistance.

Yttrium or lanthanum or both may optionally be present in a total amount of up to 0.2% for improved tensile and creep ductility in the intermediate temperature range of 600° to 900° C. Amounts in excess of 0.2% lead to inadequate ductility and stress-rupture properties.

Of the elements that may be present as impurities, silicon has a deleterious effect on corrosion resistance and should be kept below 1% and preferably below 0.5%. Other impurities may include up to 1% manganese and up to 3% iron.

A particularly advantageous combination of properties is exhibited by alloys containing from 0.04 to 0.2% carbon, from 21 to 24% chromium, from 10 to 20% cobalt, from 0 to 1% molybdenum, from 1.5 to 4% tungsten, from 0.75 to 1.5% niobium, from 1 to 2% tantalum, from 3 to 4.5% titanium, from 1.5 to 2.5% aluminum, with the total of titanium and aluminum from 4.75 to 6% and the ratio of titanium to aluminum from 1:1 to 3:1, from 0.05 to 0.25% zirconium, and from 0.005 to 0.02% boron, the balance, apart from impurities, being nickel.

An especially preferred group of alloys contain from 0.13 to 0.18% carbon, from 22 to 23.5% chromium, from 12 to 17% cobalt, from 1.5 to 4% tungsten, from 0.75 to 1.5% niobium, from 1.0 to 2.0% tantalum, from 3.3 to 4% titanium, from 1.6 to 2% aluminum, from 0.07 to 0.15% zirconium and from 0.007 to 0.015% boron, the balance, apart from impurities, being nickel.

For the optimum stress-rupture properties, the tantalum, niobium, titanium and aluminum contents of the especially preferred group of alloys are advantageously correlated such that $$6.7 \leqq \tfrac{1}{2}(\%Ta) + \%\ Nb + \%\ Ti + \%\ Al \leqq 7.7.$$

Within the composition ranges set forth above, the greatest resistance to the formation of sigma phase on prolonged heating at elevated temperatures is exhibited by alloys in which the 'electron vacancy number' (calculated by the standard "Severn Springs") method is less than 2.7, and preferably the proportion of the various constituents is such that it is less than 2.65.

To develop the full stress-rupture properties, the alloy should be subjected to a heat treatment comprising solution heating and subsequent aging, the solution treatment comprising heating from one to twenty hours at 1050° to 1250° C, with the aging treatment involving heating for from one to twenty-four hours at a temperature in the range of from 600° to 950° C. An intermediate aging consisting of heating for from one to sixteen hours at 800 to 1150° C may, if desired, be interposed between the solution treatment and the final aging stages. The alloys may be cooled at any convenient rate after each heat treatment stage, e.g. by air cooling (generally to room temperature) or by direct transfer from a furnace at one temperature to one at a lower temperature.

Two particularly advantageous heat treatments are as follows:

a. Solution-heat for 4 hours at 1150° C, air-cool, and then age for 16 hours at 850° C and again air-cool.

b. Solution-heat for 16 hours at 1200° C, air-cool, heat for 2–4 hours at 1100°–1150° C, air-cool, and finally age for 16 hours at 800° C and again air cool.

In order to illustrate the improved stress-rupture properties exhibited by alloys of the invention, a number of alloys were vacuum melted and cast in vacuum to tapered test bar blanks, from which test pieces were machined. The test pieces were given heat treatment (a) and subjected to stress-rupture tests at 22 kgf/mm² and 870° C.

The results of these tests on a number of alloys falling within the invention (alloys Nos. 1 – 18) and a number of alloys outside the scope thereof (alloys A – G) are set forth in Table 1.

TABLE 1

| | Analyzed Composition Wt.% | | | | | | | | | | | Stress-rupture 22 kgf/mm²/870° C | |
|---|---|---|---|---|---|---|---|---|---|---|---|---|---|
| Alloy | C | Cr | Co | Mo | W | Nb | Ta | Ti | Al | Zr | B | Life h | Elong. % |
| A | 0.14 | 22.7 | — | — | 2.80 | 0.90 | 1.60 | 3.48 | 1.93 | 0.22 | 0.011 | 33,35 | 9.9,9.5 |
| 1 | 0.15 | 22.4 | 7.4 | — | 2.48 | 0.80 | 1.60 | 3.46 | 1.93 | 0.13 | 0.012 | 188 | 3.1 |
| 2 | 0.15 | 22.6 | 10.0 | — | 2.40 | 0.85 | 1.45 | 3.50 | 2.02 | 0.12 | 0.011 | 300 | 7.2 |
| 3 | 0.16 | 22.7 | 14.4 | — | 2.10 | 0.80 | 1.45 | 3.60 | 1.79 | 0.12 | 0.011 | 388 | 7.2 |
| B | 0.14 | 22.6 | — | — | 2.80 | 1.35 | 1.60 | 3.40 | 1.93 | 0.22 | 0.011 | 20,33 | 11.0,5.0 |
| 4 | 0.15 | 22.4 | 7.4 | — | 2.42 | 1.30 | 1.60 | 3.40 | 1.93 | 0.13 | 0.011 | 223 | 2.5 |
| 5 | 0.16 | 22.9 | 15.2 | — | 2.0 | 1.3 | 1.3 | 3.65 | 1.86 | 0.11 | 0.009 | 534 | 4.6 |
| 6 | 0.15 | 24.0 | 14.9 | 3.15 | — | 1.05 | 1.5 | 2.80 | 1.39 | 0.12 | 0.012 | 212,260 | 19.6,14.9 |
| 7 | " | " | " | " | — | " | " | 3.0 | 1.70 | " | " | 235,270 | 9.6,10.7 |
| C | 0.15 | 22.7 | 14.4 | 3.05 | — | 0.90 | 1.6 | 4.05 | 2.05 | 0.13 | 0.012 | 135 | 4.2 |
| D | " | " | " | " | — | " | " | 4.3 | 2.19 | " | " | 52,39 | 9.1,4.9 |
| E | 0.16 | 23.2 | 15.4 | <0.1 | <0.2 | 0.70 | 1.5 | 3.0 | 1.52 | 0.09 | 0.008 | 108 | 6.5 |
| 8 | 0.16 | 23.1 | 15.2 | <0.1 | 1.0 | 0.70 | 1.5 | 3.0 | 1.52 | 0.09 | 0.008 | 150,226 | 6.9,7.4 |
| 9 | 0.13 | 22.7 | 15.5 | — | 2.2 | 0.80 | 1.7 | 3.0 | 1.55 | 0.10 | 0.009 | 168,243 | 10.2,2.4 |
| 10 | 0.14 | 22.8 | 15.4 | — | 4.0 | 0.75 | 1.6 | 2.8 | 1.55 | 0.10 | 0.009 | 274 | 9.6 |
| F | 0.14 | 22.8 | 15.3 | 1.05 | 2.0 | 0.80 | 0.2 | 2.95 | 1.55 | 0.10 | 0.008 | 112 | 16.2 |
| G | 0.14 | 22.8 | 15.4 | 1.00 | 2.1 | 1.55 | 0.2 | 2.9 | 1.55 | 0.10 | 0.008 | 116 | 10.0 |
| 11 | 0.16 | 22.6 | 15.4 | 1.05 | 2.0 | 0.8 | 1.1 | 2.9 | 1.51 | 0.10 | 0.009 | 183 | 10.5 |
| 12 | 0.16 | 22.4 | 15.5 | 1.05 | 2.1 | 1.45 | 1.1 | 2.85 | 1.51 | 0.10 | 0.009 | 265 | 16.3 |
| 13 | 0.14 | 23.0 | 15.0 | 1.05 | 2.05 | 0.2 | 1.6 | 3.0 | 1.55 | 0.10 | 0.008 | 193 | 14.3 |
| 14 | 0.14 | 22.9 | 15.0 | 1.05 | 2.1 | 0.75 | 1.6 | 3.0 | 1.55 | 0.10 | 0.009 | 174 | 14.2 |
| 15 | 0.14 | 23.1 | 15.4 | 1.05 | 1.9 | 2.00 | 1.5 | 2.9 | 1.54 | 0.12 | 0.009 | 256 | 9.8 |
| 16 | 0.16 | 22.9 | 15.2 | — | 2.0 | 1.0 | 1.35 | 3.70 | 1.86 | 0.12 | 0.009 | 485 | 5.8 |
| 17 | 0.17 | 22.9 | 15.1 | — | 1.85 | 0.95 | 1.05 | 3.65 | 1.88 | 0.12 | 0.009 | 452 | 4.4 |
| 18 | 0.17 | 22.5 | 15.1 | — | 1.85 | 0.95 | 1.6 | 3.6 | 1.87 | 0.12 | 0.009 | 405 | 4.5 |

The need to maintain the amounts of chromium, cobalt, molybdenum, tungsten, titanium, aluminum, niobium and tantalum within the above defined ranges in order to achieve adequate strength and avoid embrittlement can be seen from the above results. Thus, alloys A and B which were cobalt-free had greatly inferior stress-rupture lives as compared with alloys 1 – 5 which contained cobalt but were otherwise compositionally similar. Comparison of alloys Nos. 6 and 7 with alloys C and D illustrates the fact that the strength and ductility of tungsten-free alloys with high molybdenum contents fall off if the total of titanium and aluminum is more than about 6%.

Alloy E being virtually substantially molybdenum- and tungsten-free exhibited inadequate life (see alloys 8 – 10 for comparison). It will also be noted that alloys F and G, which contained only 0.2% tantalum, are considerably inferior in strength to alloys 11 and 12, which have higher tantalum contents but are otherwise compositionally similar. Alloys 3, 5 and 16 – 18 fall within the preferred group of alloys defined above and exhibit extremely high stress-rupture lives having regard to the test conditions.

It will be further observed from Table I that tests on alloys of the invention generally gave stress-rupture lives at 22 kgf/mm² and 870° C in excess of about 150 hours while the preferred alloys of the invention exhibited stress-rupture lives under these conditions of at least 280 hours, while the alloys in the especially preferred range manifested a life of at least 320 hours under the same conditions of test.

To illustrate the fact that the especially preferred alloys exhibit optimum stress-rupture properties when their composition is further restricted by the relationship $$6.7 \leqq \tfrac{1}{2}\ (\%Ta) + \%\ Nb + \%\ Ti + \%\ Al \leqq 7.7,$$

the further alloys shown in Table 2 were made and tested. In addition to the analyzed niobium, tantalum and titanium plus aluminum contents shown in the Table, these alloys also contained (nominally) 0.15% carbon, 23% chromium, 15% cobalt, 2% tungsten, 0.1% zirconium, 0.01% boron, balance nickel and had a titanium to aluminum ratio of 2:1. After production and heat treatment as described above in connection with the alloys of Table 1, the stress rupture life and elongation of the alloys were determined at 28 kgf/mm² and 816° C.

Table 2

| Alloy | Analyzed Content (%) Nb | Ta | Ti + Al | ½Ta + Nb + Ti + Al (%) | Stress-rupture Properties 28 kgf/mm²/816° C Life (h) | Elong (%) |
|---|---|---|---|---|---|---|
| 19 | 0.76 | 1.13 | 5.99 | 7.32 | 1654 | 1.9 |
| 20 | 0.76 | 1.13 | 5.83 | 7.16 | 1495 | 3.2 |
| 21* | 0.75 | 1.13 | 4.84 | 6.16 | 696 | 6.2 |
| 22 | 0.75 | 1.80 | 5.81 | 7.46 | 1280 | 2.1 |
| 23 | 0.75 | 1.73 | 5.45 | 7.07 | 1237 | 3.6 |
| 24 | 1.02 | 1.48 | 5.30 | 7.06 | 1441 | 3.9 |
| 25 | 0.99 | 1.40 | 5.03 | 6.72 | 1190 | 4.4 |
| 26* | 0.99 | 1.40 | 4.75 | 6.44 | 727 | 6.0 |
| 27* | 1.01 | 1.43 | 6.18 | 7.91 | 956 | 1.5 |
| 28 | 1.30 | 1.13 | 5.66 | 7.53 | 1330 | 3.6 |
| 29* | 1.33 | 1.78 | 5.71 | 7.93 | 926 | 1.2 |

It can be also seen from these further results that the alloys that obey the relationship between tantalum, niobium, titanium and aluminum all have remarkably good stress-rupture properties. The properties of alloys 21, 26, 27 and 29 (indicated by an asterisk), which do not obey the relationship are somewhat inferior, though still very good.

As above indicated, alloys within the invention exhibit good microstructural stability, i.e., resist the onset of embrittlement upon long term exposure to elevated temperatures. This is reflected by Alloy 30, Table 3. Various prior art alloys, H through M, are included for purposes of comparison, the alloys having been heated at 1121° C for 2 hours and then at 843° C for 24 hours.

TABLE 3

| Alloy | Cr % | Co % | Mo % | W % | Cb % | Ta % | Al % | Ti % | C % | IMPACT, JOULES Heat Treated | 500 hr. 1500° F. | 1000 hr. 1500° F. |
|---|---|---|---|---|---|---|---|---|---|---|---|---|
| H | 22.7 | 10 | 1 | 2.5 | 1 | 1.25 | 6 | 1 | 0.18 | 13 | 15 | 15 |
| I | 22.7 | 10 | 1 | 2 | 1 | 1 | 5 | 2 | 0.16 | 11 | 15 | 18 |
| J | 22.7 | 10.1 | 1 | 2.35 | 1.03 | 1.20 | 5.25 | 1.75 | 0.15 | 8 | 10 | 10 |
| K | 22.7 | 10 | 1.1 | 2.4 | 0.9 | 1.25 | 5.2 | 1.8 | 0.17 | 6 | 7 | 10 |
| L | 22.7 | 9 | 0.99 | 2.3 | 0.86 | 1.20 | 5.2 | 1.57 | 0.18 | 14 | 18 | 15 |
| M | 22.7 | 10 | 2 | 2.5 | 1 | 2 | 3 | 4 | 0.18 | 10 | 5 | 4 |
| 30 | 22.7 | 18.6 | — | 2.22 | 0.96 | 1.42 | 2.07 | 3.63 | 0.16 | 40 | 45 | 34 |

Alloys H, I, J, K, L and M had 0.1% Zr and 0.02% B added, respectively.
Alloy 30 nominally contained 0.12% Zr and 0.012% B.

In table 4 are reported the stress-rupture properties of the alloys.

TABLE 4

| Alloy | Cr % | Creep Rupture Results 40,000 psi Hours | 1500° F. % Elong. |
|---|---|---|---|
| H | 22.7 | 109 | 2.4 |
| I | 22.7 | 28 | 5.9 |
| J | 22.7 | 19 | 5.6 |
| K | 22.7 | 16 | 2.8 |
| L | 22.7 | 62 | 3.4 |
| M | 22.7 | 24 | 5.2 |
| 30 | 22.7 | 2002 | 10.2 |

In Table 5 are set forth the compositions and properties of a number of additional alloys of the invention which contain hafnium or yttrium. These alloys were produced and heat treated as described above in connection with the alloys of Table 1, and tested for stress-rupture life and elongation at 19 kgf/mm² and 870° C. Hafnium from 0.5% to 1.5% and yttrium and/or lanthanum from 0.02 to 0.15% in total are beneficial.

TABLE 5

| Alloy | Analyzed Composition Wt.% C | Cr | Co | W | Nb | Ta | Ti | Al | Zr | B | Hf | Y | Stress-rupture 19kgf/mm²/870° C Life h | Elong.% |
|---|---|---|---|---|---|---|---|---|---|---|---|---|---|---|
| 31 | 0.15 | 22.3 | 14.8 | 2.0 | 1.35 | 1.45 | 3.65 | 1.90 | 0.11 | 0.009 | — | — | 645 | 4.9 |
| 32 | " | " | " | " | " | " | " | " | " | " | 0.75 | — | 743 | 6.0 |
| 33 | " | " | " | " | " | " | " | " | " | " | — | 0.05 | 825 | 3.0 |
| 34 | 0.16 | 22.6 | 14.9 | 1.8 | 1.0 | 1.8 | 3.6 | 1.85 | 0.10 | 0.009 | — | — | 780,847 | 4.5 |
| 35 | " | " | " | " | " | " | " | " | " | " | 0.75 | — | 767 | 5.1 |
| 36 | " | " | " | " | " | " | " | " | " | " | — | 0.05 | 434 | 2.1 |

Although these alloys are primarily intended for use in the cast form, they also have excellent properties, and may be used to advantage, in the wrought form. The results of stress-rupture tests on an alloy (Alloy 37) according to the invention in both the cast and wrought forms are set forth in Table 7, which also includes the results of similar tests on one of the strongest commercially-available wrought alloys (Alloy N). The nominal composition of the alloys is given in Table 6.

The cast test-piece were prepared as described in connection with Table 1, while the wrought test-pieces were machined from ⅝ inch (16 mm) diameter bar extended at 1120° C from 3 kg. ingots vacuum-cast from vacuum-melted alloy. Both wrought and cast test-pieces were given heat treatment (a) before testing.

TABLE 6

| Alloy | Composition (wt %) C | Cr | Co | Mo | W | Nb | Ta | Ti | Al | Zr | B |
|---|---|---|---|---|---|---|---|---|---|---|---|
| 37 | 0.15 | 22 | 15 | 1 | 2 | 0.75 | 1.5 | 3.5 | 1.7 | 0.12 | 0.01 |
| N | 0.05 | 25 | 20 | 2 | — | 1 | — | 3 | 1.5 | 0.07 | 0.003 |

TABLE 7

| Alloy | Form | Stress-rupture properties at 870° C Stress(kgf/mm²) | Life (h) | El (%) |
|---|---|---|---|---|
| 37 | Cast | 25 | 137 | 7.8 |
| | | 22 | 431 | 7.1 |

TABLE 7-continued

| Stress-rupture properties at 870° C | | | | |
|---|---|---|---|---|
| Alloy | Form | Stress(kgf/mm²) | Life (h) | El (%) |
| 37 | Wrought | 18.9 | 240 | 6.1 |
| | | 15.8 | 557 | 22.3 |
| | | 12.6 | 1354 | 22.0 |
| N | Wrought | 20.5 | 93 | 8.6 |
| | | 17.3 | 189 | 10.2 |
| | | 14.2 | 486 | 6.8 |

The invention specifically includes parts of gas turbine engines, for example, gas turbine rotor or stator blades, both with and without cooling passages, and integrally bladed discs, and other shaped articles and parts cast from the alloys of the invention.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. A nickel-base alloy adapted for use at elevated temperature and characterized by high stress-rupture strength and good corrosion resistance in sulphur- and chloride-containing environments while concomitantly exhibiting extended resistance to embrittlement for long periods upon prolonged exposure to temperatures at least as high as 870° C., said alloy consisting of about 21% to 24% chromium, about 5% to 25% cobalt, from 1% to 5% tungsten, up to 3.5% molybdenum, the tungsten and molybdenum being correlated such that the %W + 0.5 (% Mo) is not greater than about 5%, about 1.7% to 5% titanium and about 1% to 4% aluminum, the sum of the titanium and aluminum being about 4% to 6.5% with the ratio therebetween being from 0.75:1 to 4:1, from 0.02% to 0.25% carbon, from 0.5% to 3% tantalum, about 0.3% to 2% niobium, 0.005% to 1% zirconium and up to 2% hafnium, the value of %Zr + 0.5 (% Hf) being from about 0.01% to 1%, about 0.001% to 0.05% boron, up to about 0.2% in total of yttrium and/or lanthanum, and the balance being essentially nickel in an amount of at least 30%.

2. An alloy in accordance with claim 1 containing from 4.75% to 6% of titanium plus aluminum, the ratio of the former to the latter being from cobalt 1:1 to 3:1 and 10% to 20%.

3. An alloy in accordance with claim 1 in which tungsten does not exceed 4% and the carbon is from 0.04% to 0.2% and tantalum is 0.6% to 2.5%.

4. An alloy in accordance with claim 2 containing 0.01% to 0.5% zirconium and from 0.003% to 0.03% boron.

5. An alloy in accordance with claim 4 containing from 0.5% to 1.5% hafnium.

6. An alloy in accordance with claim 1 containing 21% to 24% chromium, 10% to 20% cobalt, 1.5% to 4% tungsten, up to 1% molybdenum, 1% to 2% tantalum, 0.75% to 1.5% columbium, 3% to 4.5% titanium, 1.5% to 2.5% aluminum, the sum of the titanium and aluminum being 4.75% to 6%, and the ratio therebetween being 1:1 to 3:1, 0.04% to 0.2% carbon, 0.05% to 0.25% zirconium and from 0.002% to 0.02% boron.

7. An alloy in accordance with claim 1 in which the tantalum, niobium, titanium and aluminum are correlated to satisfy the following relationship $$6.7 \leqq \tfrac{1}{2}(\%Ta) + \%Nb + \%Ti + \%Al \leqq 7.7.$$

8. An alloy in accordance with claim 6 in which the tantalum, niobium, titanium and aluminum are correlated to satisfy the following relationship $$6.7 \leqq \tfrac{1}{2}(\%Ta) + \%Nb + \%Ti + \%Al \leqq 7.7.$$

* * * * *